US009848635B2

(12) United States Patent
Hopps

(10) Patent No.: US 9,848,635 B2
(45) Date of Patent: Dec. 26, 2017

(54) APPARATUS FOR CREATING LIQUID TOBACCO EXTRACT

(71) Applicant: JT INTERNATIONAL SA, Geneva (CH)

(72) Inventor: Jason Hopps, Coleraine (GB)

(73) Assignee: JT INTERNATIONAL SA (CH)

( * ) Notice: Subject to any disclaimer, the term of this patent is extended or adjusted under 35 U.S.C. 154(b) by 782 days.

(21) Appl. No.: 14/354,887

(22) PCT Filed: Oct. 26, 2012

(86) PCT No.: PCT/EP2012/071233

§ 371 (c)(1),
(2) Date: Apr. 28, 2014

(87) PCT Pub. No.: WO2013/060827

PCT Pub. Date: May 2, 2013

(65) Prior Publication Data

US 2014/0261483 A1 Sep. 18, 2014

(30) Foreign Application Priority Data

Oct. 28, 2011 (GB) ..... 1118689.7

(51) Int. Cl.
*A24F 47/00* (2006.01)
*A24B 15/26* (2006.01)
*A24B 15/24* (2006.01)

(52) U.S. Cl.
CPC ..... *A24B 15/26* (2013.01); *A24B 15/24* (2013.01); *A24F 47/002* (2013.01)

(58) Field of Classification Search
None
See application file for complete search history.

(56) References Cited

U.S. PATENT DOCUMENTS 4,171,000 A 10/1979 Uhle
4,393,884 A * 7/1983 Jacobs ..... A24F 47/002 128/200.23
4,635,651 A 1/1987 Jacobs
5,159,942 A 11/1992 Brinkley et al.
(Continued)

OTHER PUBLICATIONS

International Search Report and Written Opinion for PCT/EP2012/071233, dated May 3, 2013, 9 pages.
(Continued)

*Primary Examiner* — Eric Yaary
(74) *Attorney, Agent, or Firm* — Hovey Williams LLP

(57) ABSTRACT

A kit is disclosed for supplying a cartridge of an inhaler article with liquid tobacco extract, the kit comprising an apparatus having means for extracting a liquid tobacco extract from a tobacco derived solid. The apparatus is adapted to deliver liquid tobacco extract to a cartridge and a cartridge adapted to receive liquid tobacco extract from the apparatus. An apparatus for supplying a liquid tobacco extract to a cartridge of an inhaler article is further disclosed. The apparatus has a housing, means for extracting a liquid tobacco extract from a tobacco derived solid and said housing is adapted to deliver liquid tobacco extract to a cartridge of an inhaler article. A related method of supplying a cartridge of an inhaler article with a liquid tobacco extract is further disclosed.

5 Claims, 3 Drawing Sheets

(56) References Cited

U.S. PATENT DOCUMENTS

| | | | | |
|---|---|---|---|---|
| 2005/0224136 | A1* | 10/2005 | Hayes | A24C 5/608 141/329 |
| 2010/0200008 | A1 | 8/2010 | Taieb | |
| 2011/0036365 | A1* | 2/2011 | Chong | A24B 15/18 131/306 |
| 2011/0120482 | A1* | 5/2011 | Brenneise | A24F 47/008 131/328 |
| 2011/0290244 | A1* | 12/2011 | Schennum | A61M 15/06 128/200.23 |
| 2011/0290826 | A1* | 12/2011 | Harris | B65D 83/0044 222/319 |
| 2012/0167906 | A1* | 7/2012 | Gysland | A24F 47/008 131/328 |

OTHER PUBLICATIONS

Anonymous: "How to Refill E-Liq," Company Website: www.e-cig.com; Mar. 28, 2010, URL: http://web.archive.org/web/20100328030938/http://www.e-cig.com/shopping/shopcontent.asp?type=howtorefill; Retrieved: Feb. 15, 2013.

Anonymous: "E-Liq Recipes," Company Website: www.e-cig.com; Oct. 28, 2010; URL: http://web.archive.org/web/20101028103107/http://www.e-cig.com/shopping/shopcontent.asp?type=eliqrecipes; Retrieved: Feb. 15, 2013.

* cited by examiner

APPARATUS FOR CREATING LIQUID TOBACCO EXTRACT

RELATED APPLICATION

The present application is a national stage application under 35 U.S.C. §371 of International Application No. PCT/EP2012/071233, filed Oct. 26, 2012, which is incorporated by reference herein in its entirety.

FIELD OF THE INVENTION

The present invention relates to a method, kit and apparatus for providing the cartridge of an inhaler article with a liquid tobacco extract.

BACKGROUND

An inhaler article is a device that simulates the act of tobacco smoking by producing an inhaled mist which closely matches flavor of inhaled tobacco smoke. Inhaler articles can produce inhalable mist by many different mechanisms, for example by heating a propylene glycol or glycerin-based liquid solution and allowing the vapourised solution to condense into microscopic droplets. The heat can be produced by energy supplied by a fuel or by electricity usually stored into a battery. Most inhaler articles are designed to resemble actual tobacco smoking implements, such as cigarettes, cigars, or pipes.

An example of an inhaler that produces an inhalable mist from a battery-based electrical energy is an electronic cigarette. Electronic cigarettes generally consist of three primary components: a cartridge, an atomizer, and a battery unit. The cartridge comprises an absorbent mesh that is soaked with a solution of flavour and aroma compounds, propylene glycol, water and aroma compounds. The cartridge is usually disposable such that when the user senses that the amount of flavour and aroma compounds in the cartridge are run down he is able to replace the used cartridge with a new cartridge.

The inhalable mist generated from such inhalers often lacks specific sensory attributes associated with tobacco smoking implements, since they usually do not contain tobacco. Attempts have been made to overcome this problem by providing solid tobacco within the device as the source of flavour and aroma.

It is desirable to extract the flavour and aroma compounds as close as possible in time to the moment when the user operates the electronic inhaler device, to closely match the flavour of inhaled tobacco smoke, and thus the smoking sensation. Attempts have been made to overcome this problem by providing cut tobacco within the cartridge as the source of flavour and aroma. For example, WO2008/108889 discloses various configurations of an e-cigarette in which a cartridge is loaded. The cartridge may have cut tobacco or tobacco extract. However, because there must be an unimpeded physical flow of liquid from the cartridge to the heating element during use, cut tobacco is not readily suitable for direct insertion into existing cartridge for inhaler articles because the tobacco particles can easily impede the flow of liquid towards the heating element. Furthermore, tobacco particles can easily cause failure of the wick and heating elements of an electronic inhalable article.

The present invention aims to address the problems associated with the prior art.

SUMMARY OF THE INVENTION

The inventors of the present invention have overcome the problems in the prior art by designing apparatus which may be used by the end user to extract a liquid tobacco extract from a tobacco derived solid and delivering the extract to a refillable cartridge of an inhaler article. As a result, the end user is able to generate the liquid flavour and aroma extract during refilling of the cartridge whilst avoiding the use of a tobacco derived solid within the cartridge.

The tobacco derived solid as referred above can mean cut, ground, reconstituted, shredded, milled, or processed in any way by which its particle size is decreased. In the following described exemplary embodiments, the tobacco derived solid will be cut tobacco.

In a first aspect, the present invention is a kit for supplying a cartridge of an inhaler article with liquid tobacco extract, the kit comprising an apparatus having disposed therein a means for extracting a liquid tobacco extract from a tobacco derived solid said apparatus adapted to deliver liquid tobacco extract to a cartridge and a cartridge adapted to receive liquid tobacco extract from the apparatus.

In a second aspect, the present invention is an apparatus for supplying a liquid tobacco extract to a cartridge of an inhaler article, the apparatus comprising a housing having disposed therein a means for extracting a liquid tobacco extract from a tobacco derived solid derived solid wherein said housing is adapted to deliver liquid tobacco extract to a cartridge of an inhaler article.

In a third aspect, the present invention is a method of supplying a cartridge of an inhaler article with a liquid tobacco comprising:

a. providing an apparatus of any preceding claim;
b. loading the housing of the apparatus with tobacco derived solid and a solvent;
c. extracting a tobacco extract from the tobacco derived solid to form a liquid tobacco extract and solvent mixture; and
d. providing a cartridge of an inhaler article and delivering the tobacco extract to the cartridge

DETAILED DESCRIPTION OF THE INVENTION

The present invention provides apparatus, a kit and a method for providing a liquid tobacco extract from cut tobacco for refilling a cartridge of an inhaler article. Preferably, the inhaler article is an electronic cigarette, cigar or pipe.

The apparatus comprises a housing in which cut tobacco and a solvent is provided. The apparatus may be supplied to the end user with tobacco and solvent already present within the housing. The housing may be adapted such that the user may supply his own cut tobacco in to the apparatus from which he extracts liquid tobacco extract. The cut tobacco may be any tobacco known in the art from which a liquid tobacco extract may be obtained for use in refilling the cartridge of an inhaler article. The solvent may be any solvent used in the art for carrying and impregnating tobacco extract in to a cartridge of an inhaler article. Preferably the solvent is water, propylene glycol, glycerol or mixtures thereof.

The cut tobacco and solvent may be provided as a mixture within the housing. The housing may be adapted to keep the cut tobacco and solvent separate such that the solvent is mixed with the tobacco by the user during the extraction process.

A liquid tobacco extraction means is provided within the housing of the apparatus of the present invention. The extraction means may be a filter which allows the passage of a solvent with tobacco extract through but which retains tobacco particles.

Particles of tobacco-derived solid can be removed from the liquid extract by a variety of means, such as physical separation (for example, steel mesh filtration or a Franz cell silicone membrane). Additionally, chemical filtration can be applied, wherein desirable components of the tobacco-derived solid can freely pass into the liquid extract, and undesirable components of the tobacco-derived solid cannot pass through the filtration mechanism. Thus, the filtration mechanism can be designed according to which elements of the tobacco-derived solid are desirable in the liquid extract, for example, to control intensity of tobacco-like aroma.

Examples of chemical filtration mechanisms include selectively-permeable membranes, such as those used in dialysis or reverse osmosis. The materials used to construct such membranes can control the membranes permeability to various chemical groups, based on key parameters such as molecular size, molecular weight or polarity. Examples of such materials include polyimide, polydimethylsiloxane and regenerated cellulose.

The apparatus of the present invention may be in the form of a bottle which is adapted to detachably receive a cartridge. The bottle may comprise a housing which is deformable such that liquid tobacco extract may be dispensed from the bottle into the cartridge when an external deformable force is applied to the housing by the user. In this embodiment it is preferable that the cut tobacco is provided as a mixture with the solvent. Preferably the apparatus has a housing in the form of a cylinder, such as a hollow pen shaft. A plunger may be slideably mounted within the interior of the shaft which forces solvent to pass through the cut tobacco during the extraction process. More preferably, the apparatus may be in the form of a metered dose spray which delivers a measured dose of liquid tobacco extract to a cartridge.

The housing of the apparatus of the invention may be adapted to detachably receive a cartridge such that liquid tobacco extract may be dispensed from the apparatus into the cartridge and the cartridge then removed from the apparatus for use in the inhaler article. The apparatus may comprise the detachable cartridge or the apparatus may be provided along with the cartridge as a separate component but in a kit of parts. Preferably the apparatus is provided without the cartridge.

Examples of the present invention will now be described with reference to the accompanying drawings, in which.

Figure 1:
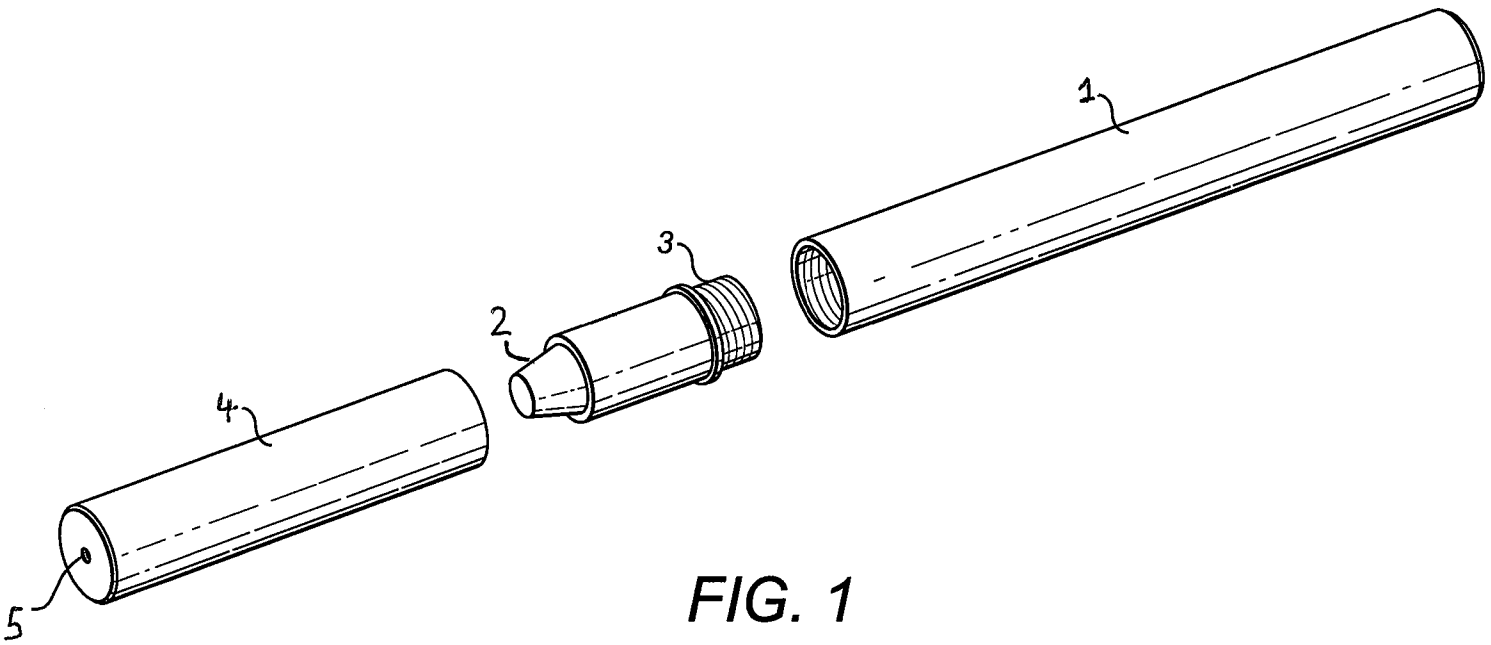
FIG. 1 Prior Art
FIG. 1 shows an electronic cigarette and a disposable cartridge.

With reference to FIG. 1 an electronic cigarette has three component parts; a rechargeable battery and circuitry (1), a heater (2) and wick (3) and refillable flavour and aroma containing cartridge (4). The cartridge (4) comprises a housing in which is positioned an absorbent mesh or fibre matrix soaked in a solution of flavour and aroma, propylene glycol, water and aroma compounds. The heater (2) comprising a metal wire wrapped around an insulator is position at the non-smoking end of the cartridge (4) the other end of the cartridge (4) provided with a hole (5) which allows passage of air through the cartridge to the outside during the smoking process. The wick (3) comprises a porous and heart resistant material which is in close proximity to the heat source which is able to transfer volatilised propylene glycol having flavour and aroma compounds therein.

In use, the propylene glycol flows from the matrix towards the heater (2) due to lower pressure during puffing, capillary action and gravity depending on how the electronic cigarette is held. As the propylene glycol is heated and volatilised by the heater (2), general air flow through the cartridge condenses the vapour into small droplets (aerosol), which then pass through the hole (5) and into the user's mouth.

Figure 2:
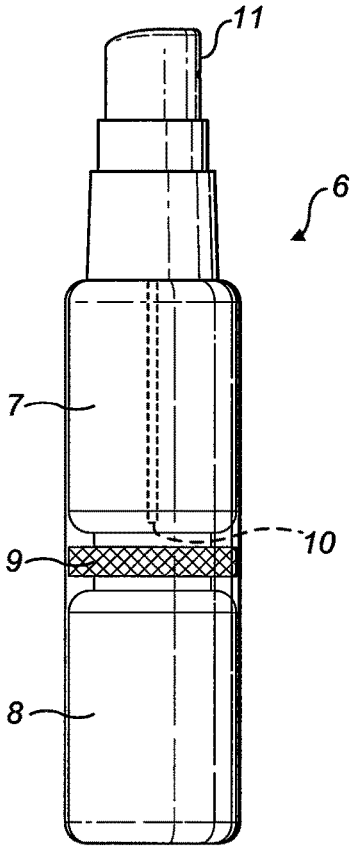
FIG. 2 shows a metered spray bottle for delivering liquid tobacco extract to a disposable cartridge.

The cartridge (4) may be refilled with liquid tobacco extract using the apparatus shown in FIG. 2. In this embodiment, the apparatus is in the form of a metered dose spray bottle (6) which delivers a predetermined amount of liquid tobacco extract to the cartridge (4) per spray. The bottle (6) is divided into an upper (7) and lower (8) compartment by a selectively permeable membrane (9), such as a Franz cell silicone membrane, or a polydimethylsiloxane membrane positioned across the interior lumen of the bottle (6). The lower compartment (8) comprises a mixture of cut tobacco and propylene glycol and the upper compartment (7) comprises propylene glycol only. The free end of a spray tube (10) is position within the propylene glycol of the upper compartment (7) such that actuation of the spray nozzle (11) causes propylene glycol to pass up through the spray tube (10) which causes tobacco solution to diffuse through the membrane and out of the nozzle (11) as a spray into a cartridge. The membrane (9) acts to stop cut tobacco particles from passing from the lower compartment (8). Thus the membrane is adapted to act as a physical barrier to let the liquid pass from the lower to the upper compartment while retaining the tobacco particles, and also a chemical filtration means, whereby the choice and thickness of membrane material can select which tobacco components may pass through, based on for example, polarity or molecular size.

Figure 3:
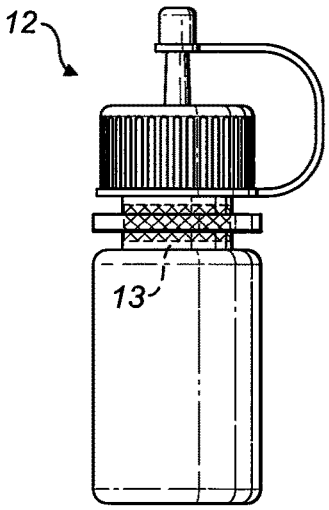
FIG. 3 shows a dropper bottle for delivering liquid tobacco extract to a disposable cartridge.

An alternative embodiment is shown in FIG. 3. A dropper bottle (12) is provided made from a deformable plastic material such as PVC. A steel mesh filter (13) is provided at the neck of the bottle (12). A mixture of cut tobacco and propylene glycol is provided within the bottle such that tobacco extract is able to dissolve in the propylene glycol. During use, the user squeezes the deformable bottle (12) which causes an increase in pressure inside the bottle. Liquid tobacco extract is forced through the steel mesh filter (13) and emerges from the bottle as drops of tobacco extract which are absorbed onto the cartridge. The mesh filter (13) retains the cut tobacco particles such that the particles do not pass into the cartridge.

Figure 4:
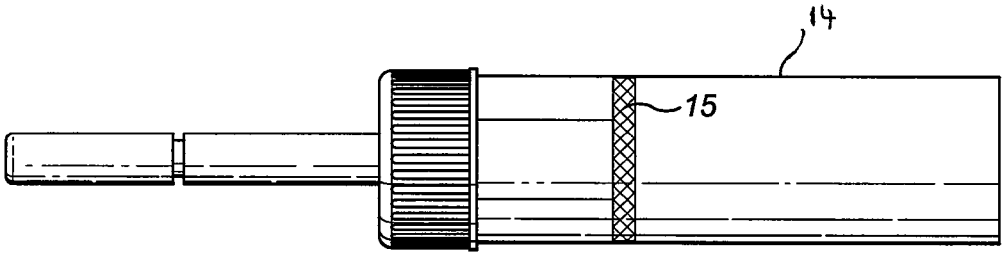
FIG. 4 shows an apparatus of the invention having a plunger mechanism for extract liquid tobacco extract from cut tobacco.
Figure 5:
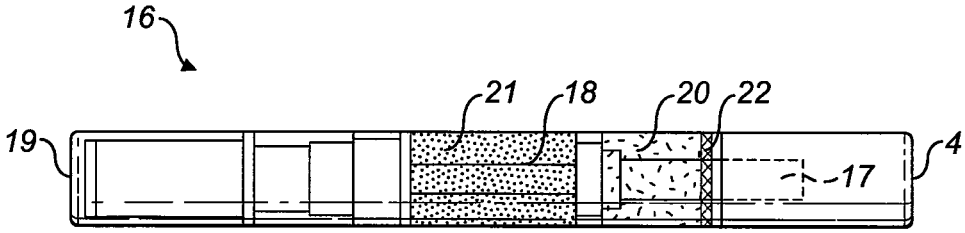
FIG. 5 shows an apparatus of the invention having a detachable cartridge into which liquid tobacco extract may be dispensed from the apparatus.

Further alternative embodiments are shown in FIGS. 4 and 5. FIG. 4 shows an apparatus having a generally cylindrical housing (14) into which is provided a mixture of cut tobacco and propylene glycol. A plunger (15) having a steel mesh filter is slideably engaged within the internal lumen of the housing (14). In use, the user forces the plunger (15) along the internal lumen of the housing (14) such that liquid tobacco extract passes through the steel mesh filter and cut tobacco particles are pushed towards the bottom of the housing (14). The liquid tobacco extract is then poured from an open end of the housing (14) into a cartridge.

The apparatus shown in the embodiment depicted in FIG. 5 also employs a plunger type mechanism to separate liquid tobacco extract from cut tobacco particles. The apparatus generally resembles a pen (16) having an open end (17) which is releasably engaged with a cartridge (4). A plunger (18) is engaged in a screw fit with the internal walls of the housing of the pen shaft the plunger having a handle (19) operable by the user. A dry tobacco mix (20) and propylene glycol (21) are provided separately in the internal lumen of the pen shaft between the plunger and opening of the pen. A coarse filter (22) is provided inside the pen shaft immediately before the opening.

In use, the user turns the plunger at the handle (19) which causes the plunger to pass within the lumen of the pen towards the open end (17). As a result, the propylene glycol (21) is forced through the dry cut tobacco (20) and tobacco extract is dissolved into the propylene glycol. Continued turning of the plunger forces the liquid tobacco extract to pass through the coarse filter (22) and out through the opening (17) and into the matrix of the cartridge (4) with which the opening is releasably engaged. Cut tobacco particles (20) are retained by the filter and do not pass through the opening (17).

The apparatus shown in FIGS. 2 to 5 allows the user to make his own liquid tobacco extract from cut tobacco and deliver the extract to a refillable cartridge. Cut tobacco particles are not delivered to the cartridge thereby solving the problems caused by prior art cartridges which use cut tobacco and its effect on cartridge performance.

The invention claimed is:

1. A kit for supplying a cartridge of an inhaler article with liquid tobacco extract, the kit comprising an apparatus having disposed therein a means for extracting a liquid tobacco extract from a tobacco derived solid, said apparatus adapted to deliver liquid tobacco extract to a cartridge of the inhaler article, the kit further comprising the cartridge of the inhaler article adapted to receive liquid tobacco extract from the apparatus; wherein said apparatus includes a housing having disposed therein a tobacco derived solid and at least one solvent selected from the group consisting of water, propylene glycol, glycerol or mixtures thereof; wherein said housing comprises a metered dose spray bottle having a propellant solvent and a mixture of the tobacco derived solid and the at least one solvent stored therein, wherein said propellant solvent and the mixture of the tobacco derived solid and the at least one solvent are separated by the means for extracting the liquid tobacco extract.

2. The kit of claim 1, wherein said means for extracting liquid tobacco extract from the tobacco derived solid is a mesh filter or selectively-permeable membrane.

3. The kit of claim 1, wherein said means for extracting the liquid tobacco extract includes a plunger which is slideably engageable with the external walls of the housing.

4. The kit of claim 1, wherein said inhaler article is an electronic cigarette.

5. A method of supplying a cartridge of an inhaler article with a liquid tobacco extract comprising:

a. providing a kit of claim 1;

b. extracting a tobacco extract from the tobacco derived solid to form a liquid tobacco extract and solvent mixture; and c. delivering the tobacco extract to the cartridge of the inhaler article.

* * * * *